US006311912B1

(12) United States Patent
Chang

(10) Patent No.: US 6,311,912 B1
(45) Date of Patent: Nov. 6, 2001

(54) SHUTTLE BOBBIN FOR SEWING MACHINES

(75) Inventor: Steve Chang, Bardonia, NY (US)

(73) Assignee: Kosap Tech Co., Ltd., Dalsung-gun (KR)

( * ) Notice: Subject to any disclaimer, the term of this patent is extended or adjusted under 35 U.S.C. 154(b) by 0 days.

(21) Appl. No.: 09/622,520

(22) PCT Filed: Dec. 17, 1999

(86) PCT No.: PCT/KR99/00785

§ 371 Date: Oct. 3, 2000

§ 102(e) Date: Oct. 3, 2000

(87) PCT Pub. No.: WO00/37727

PCT Pub. Date: Jun. 29, 2000

(30) Foreign Application Priority Data

Dec. 19, 1998 (KR) ..... 98/56363

(51) Int. Cl.[7] ..... B65H 75/14; B65H 54/18
(52) U.S. Cl. ..... 242/118.41; 242/603; 112/279
(58) Field of Search ..... 242/118.41, 603, 242/484.7; 112/279

(56) References Cited

U.S. PATENT DOCUMENTS 2,340,574 * 2/1944 Ashworth ..... 242/118.41 X
4,696,438 * 9/1987 Myers ..... 242/118.41
5,078,331 * 1/1992 Mardix et al. ..... 242/118.41
5,622,127 * 4/1997 Chang ..... 112/279

* cited by examiner

*Primary Examiner*—Michael R. Mansen

(57) ABSTRACT

A shuttle bobbin (1) for sewing machines having a first (11) and second (12) disc-shaped end walls concentrically and integrally formed at both ends of a hub. The diameter of the first end wall (11) being larger than that of the second end wall (12). A partition wall (13) is concentrically and integrally formed at an intermediate portion of the hub, thus partitioning the hub into firsts and second winding parts (15*a*, 15*b*). The partition wall (13) is smoothly toothed (13*a*, 13*b*) at its outside edges, thus having rounded teeth and rounded roots at the outside edges. The diameter of the addendum circle of the toothed partition wall (13) is equal to the diameter of the first end wall (11) while the diameter of the deddendum circle is equal to the second end wall (12). The second winding part (15*b*), defined by the second end wall and the partition wall, is positioned just under the lowest position of a sewing needle when the bobbin is installed in a sewing machine. The thread carrying capacity of the above shuttle bobbin (1) is thus increased by the capacity, offered by the second winding part (15*b*), in comparison with a typical shuttle bobbin.

4 Claims, 3 Drawing Sheets

SHUTTLE BOBBIN FOR SEWING MACHINES

BACKGROUND OF THE INVENTION

1. Field of the Invention

The present invention relates, in general, to a shuttle bobbin used for carrying the lower thread in sewing machines, the lower thread meeting the upper thread so as to make a stitch on cloth, and, more particularly, to a shuttle bobbin with the thread winding hub being partitioned into two or more parts having different thread winding capacities, thus allowing the lower thread to be wound on the bobbin in a multi-step winding style, and enlarging the thread carrying capacity of the shuttle bobbin, and thereby lengthening the interval of changing an empty bobbin with a new one while improving work efficiency while performing a sewing operation.

2. Description of the Prior Art

As well known to those skilled in the art, sewing machines are designed to use a shuttle bobbin, which carries a lower thread to meet an upper thread, making a stitch on cloth. A typical shuttle bobbin for sewing machines is shown in FIG. 5. Such a known shuttle bobbin "a" is removably set in a sewing machine at an appropriate position under the sewing plate, thus allowing the lower thread to be continuously fed to the cloth on the sewing plate while performing a sewing operation. In order to continuously feed the lower thread to the cloth while performing a sewing operation, it is necessary for a user to repeatedly and periodically change an empty bobbin with a new, full bobbin of thread.

Such a shuttle bobbin is removably received in a bobbin case prior to removably installing the bobbin case in a sewing machine at an appropriate position under the sewing plate. The size or the thread carrying capacity of the shuttle bobbin is thus determined in accordance with the internal volume of the bobbin case. However, the external size of the bobbin case is internationally standardized, so that the internal volume of the bobbin case is limited. Therefore, it is almost impossible to freely enlarge the thread carrying capacity of a shuttle bobbin without being limited, so that the design of such a shuttle bobbin is limited.

In other words, the internal volume of conventional bobbin cases is limited due to the desired strength in relation to the thickness of the walls of the internationally standardized bobbin cases. In addition, the projection of the shuttle bobbins from the bobbin cases is limited to an extent free from causing any interference with a sewing needle in its lowest position, so that the size of the shuttle bobbins is limited.

In an effort to enlarge the thread carrying capacity of a shuttle bobbin while considering the above-mentioned structural limit of both the shuttle bobbins and the bobbin cases, the bobbin cases are designed to have an enlarged inner diameter which allows a shuttle bobbin to carry more thread. In such a case, it is necessary to shave the interior surface of a bobbin case so as to enlarge the inner diameter of the bobbin case suitable for receiving a shuttle bobbin, carrying more thread. However, the increase in the inner diameter of the bobbin case is structurally limited and this limits the increase in the thread winding height of the shuttle bobbin. Therefore, the bobbin cases, of which the interior surfaces are shaved so as to increase the inner diameter of the cases, fail to effectively enlarge the thread carrying capacity of shuttle bobbins. It is thus necessary for a user to repeatedly and periodically change an empty shuttle bobbin with a new, full bobbin of thread while performing a sewing operation.

This reduces work efficiency while performing a sewing operation and increases the sewing cost.

SUMMARY OF THE INVENTION

Accordingly, the present invention has been made keeping in mind the above problems occurring in the prior art, and an object of the present invention is to provide a shuttle bobbin for sewing machines, of which the thread winding hub is partitioned into two or more parts by a partition wall, thus allowing the lower thread to be wound on the bobbin in a multi-step winding style with different thread winding heights, and enlarging the thread carrying capacity of the shuttle bobbin, and thereby lengthening the interval of changing an empty bobbin with a new, full bobbin of thread, improving work efficiency while performing a sewing operation.

In order to accomplish the above object, the present invention provides a shuttle bobbin for sewing machines, comprising: a hub having an axial pin hole, thus being rotatably and removably fitted over a pin of an openable bobbin case; first and second disc-shaped end walls concentrically and integrally formed at both ends of the hub, respectively, the first end wall having an outer diameter larger than that of the second end wall; and a partition wall concentrically and integrally formed at an intermediate portion of the hub, thus partitioning the hub into first and second winding parts, the partition wall being smoothly toothed at its outside edge, thus having rounded teeth and rounded roots all around the outside edge.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* are views of a shuttle bobbin for sewing machines in accordance with the primary embodiment of the present invention, in which:

FIG. 1*a* is a perspective view; and

FIG. 1*b* is a longitudinal-sectioned view;

DETAILED DESCRIPTION OF THE PREFERRED EMBODIMENT

Figure 1A:
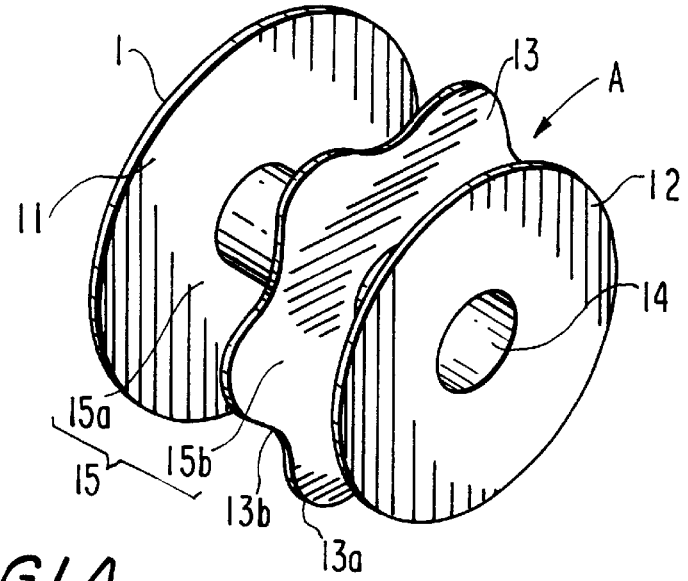
Figure 1B:
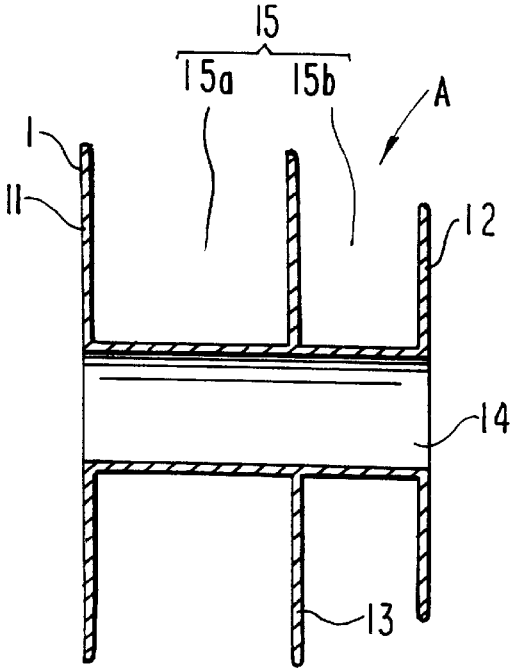
Figure 2:
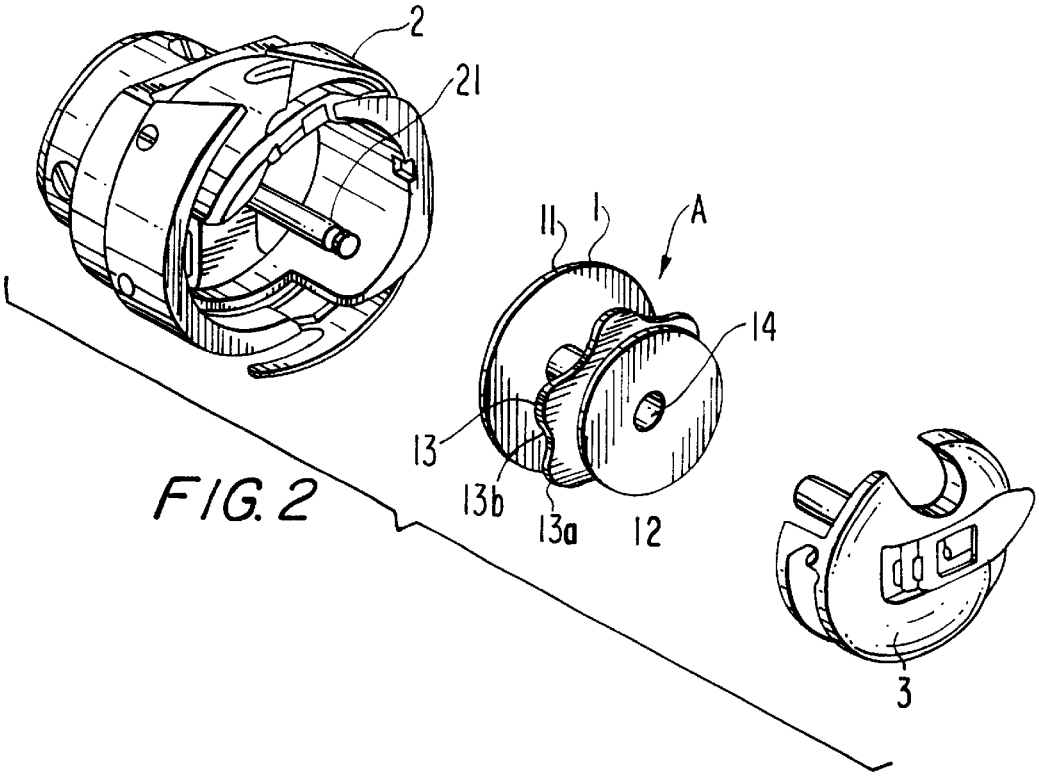
FIG. 2 is an exploded perspective view, showing the shuttle bobbin of this invention used with a conventional bobbin case.
Figure 3:
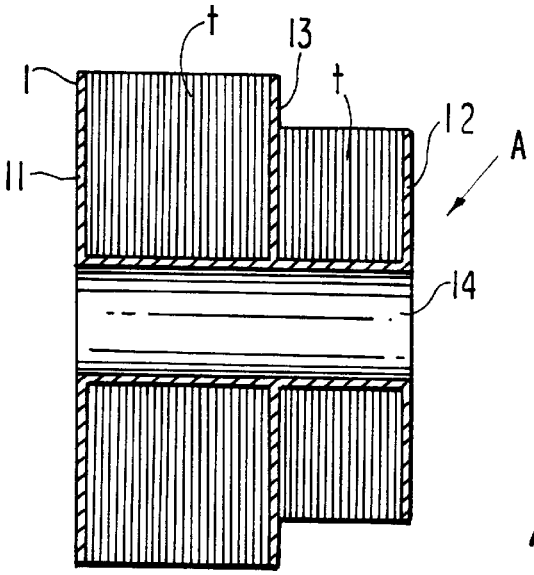
FIG. 3 is a sectional view, showing the lower thread wound on the shuttle bobbin of this invention.

FIGS. 1*a* and 1*b* are perspective and sectional views of a shuttle bobbin for sewing machines in accordance with the primary embodiment of this invention, respectively. FIG. 2 shows the above shuttle bobbin used with a conventional bobbin case. FIG. 3 shows the lower thread wound on the above shuttle bobbin.

As shown in the drawings, the shuttle bobbin A of this invention is rotatably and removably set in a conventional bobbin case 2 while being fitted over a pin 21 of the case 2. After setting the bobbin A in the bobbin case 2, the case 2 is closed by a cover 3. In order to rotatably fit the bobbin A over the pin 21, the hub 15 of the bobbin body 1 has an axial pin hole 14 of which the inner diameter is larger than the outer diameter of the pin 21. The bobbin body 1 is also provided with a disc-shaped end wall 11, 12 at each end of the hub 15. The outer diameter of the first end wall 11 is larger than that of the second end wall 12.

A partition wall 13 is concentrically and integrally formed at an intermediate portion of the hub 15 of the bobbin body 1 in a way such that the partition wall 13 is parallel to both end walls 11 and 12 as shown in FIG. 1*b*. The partition wall 13 thus partitions the hub 15 into two parts: first and second winding parts 15*a* and 15*b*, of which the first is defined by the partition wall 13 and the first end wall 11 and the second is defined by the partition wall 13 and the second end wall 12. The outside edge of the above partition wall 13 is smoothly toothed, thus having rounded teeth 13*a* and rounded roots 13*b*. In such a case, it is preferable to design the diameter of the addendum circle of the toothed partition wall 13 to be equal to the outer diameter of the first end wall 11 and the diameter of the deddendum circle of the partition wall 13 to be equal to the outer diameter of the second end wall 12.

In the above shuttle bobbin A, the partition wall 13 is preferably positioned on the hub 15 in a way such that the partition wall 13 is positioned close to a sewing needle without causing any interference with the needle during a descending action of the needle when the bobbin case 2, having the bobbin A, is set under the sewing plate of a sewing machine, with the sewing needle reaching a position just above the second winding part 15*b* of the hub 15 when it fully descends. In addition, the outer diameter of the second end wall 12, which defines the second winding part 15*b* in cooperation with the partition wall 13, is preferably designed to be away from the lowest position of the needle. As described above, the outer diameter of the second end wall 12 is preferably designed to be equal to the diameter of the deddendum circle of the toothed partition wall 13.

When winding the lower thread "t" on the hub 15 of the bobbin A, the lower thread is primarily wound on the second winding part 15*b* of the hub 15 until the lower thread is fully wound on the part 15*b* to a height almost completely leveled with the outer diameter of the second end wall 12. After the thread is fully wound on the second winding part 15*b* of the hub 15, the thread is secondarily wound on the first winding part 15*a* of the hub 15 without being cut. In such a case, the thread "t" is fully wound on the first winding part 15*a* to a height almost completely leveled with the outer diameter of the first end wall 11 defining the first winding part 15*a*. Therefore, the lower thread "t" is fully wound on the two winding parts 15*a* and 15*b* of the bobbin A in a multi-step winding style with different winding heights as best seen in FIG. 3.

Figure 5:
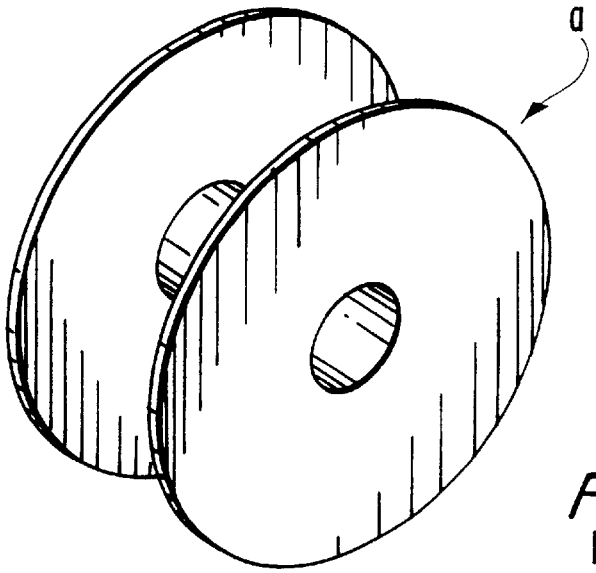
FIG. 5 PRIOR ART
FIG. 5 is a perspective view of a typical shuttle bobbin for sewing machines.

In accordance with the present invention, the thread carrying capacity of the shuttle bobbin A is increased to at least 90% in comparison with the typical bobbin of FIG. 5. Therefore, the shuttle bobbin A of this invention effectively lengthens the interval of changing an empty bobbin with a new, full bobbin of thread, so that the bobbin A improves work efficiency while performing a sewing operation.

The operational effect of the shuttle bobbin A of this invention will be described hereinbelow.

The bobbin A, fully carrying the lower thread "t" on the first and second winding parts 15*a* and 15*b* of the hub 15, is rotatably fitted over the pin 21 of a bobbin case 2 prior to closing the case 2 with a cover 3. Thereafter, the bobbin case 2 is removably installed on an appropriate position in a sewing machine. The leading end of the lower thread "t" passes through the eye of a sewing needle along with the leading end of the upper thread prior to starting the sewing machine. When the sewing machine is started, the lower thread "t" is smoothly fed from the bobbin A without being troubled. While performing a sewing operation, the lower thread "t" is primarily fed from the first winding part 15*a* of the hub 15. In such a case, the needle is positioned just above the second winding part 15*b* when the needle fully descends to its lowest position, so that the lower thread "t" from the first winding part 15*a* passes over the toothed partition wall 13 as the thread "t" is unwound from the first winding part 15*a*. In order to allow the thread "t" to smoothly pass over the partition wall 13, the partition wall 13 is smoothly toothed at its outside edge, thus having the rounded teeth 13*a* and the rounded roots 13*b* all around the outside edge. The lower thread "t" from the first winding part 15*a* thus smoothly passes over any one of the rounded roots 13*b*, so that the thread "t" is smoothly fed from the first winding part 15*a* to the needle, positioned just above the second winding part 15*b*, without being interfered with the partition wall 13. When the first winding part 15*a* is emptied, the lower thread "t" is unwound from the second winding part 15*b* without being cut, so that the sewing operation can be continued without being stopped until the two winding parts 15*a* and 15*b* are completely emptied.

As described above, the hub 15 of the shuttle bobbin A of this invention is partitioned by a partition wall 13 into two thread winding parts 15*a* and 15*b* which have different thread carrying capacities. The outside edge of the partition wall 13 is smoothly toothed, thus having rounded teeth 13*a* and rounded roots 13*b*. Due to the rounded teeth 13*a* of the partition wall 13, the lower thread "t" is wound on the first winding part 15*a* to a height almost completely leveled with the outside edge of the first end wall 11. In addition, the lower thread "t" is wound on the second winding part 15*b* to a height almost completely leveled with the outside edge of the second end wall 12 of which the diameter is smaller than that of the first end wall 11. In such a case, the lower thread "t" is not cut while being wound on the two winding parts 15*a* and 15*b*. During a sewing operation of a sewing machine, the lower thread "t" is primarily unwound from the first winding part 15*a* and smoothly passes over any one of the rounded roots 13*b* prior to reaching the lowest position of a sewing needle just above the second winding part 15*b*. Therefore, it is possible for the thread "t" to be smoothly fed from the first winding part 15*a* to the lowest position of the sewing needle without being interfered with the partition wall 13. In a brief description, the shuttle bobbin A of this invention is increased in the thread carrying capacity by the capacity, offered by the second winding part 15*b*, in comparison with the typical shuttle bobbin "a" of FIG. 5. The thread carrying capacity of the shuttle bobbin A according to this invention is thus effectively increased without changing the design of a conventional bobbin case 2.

Figure 4:
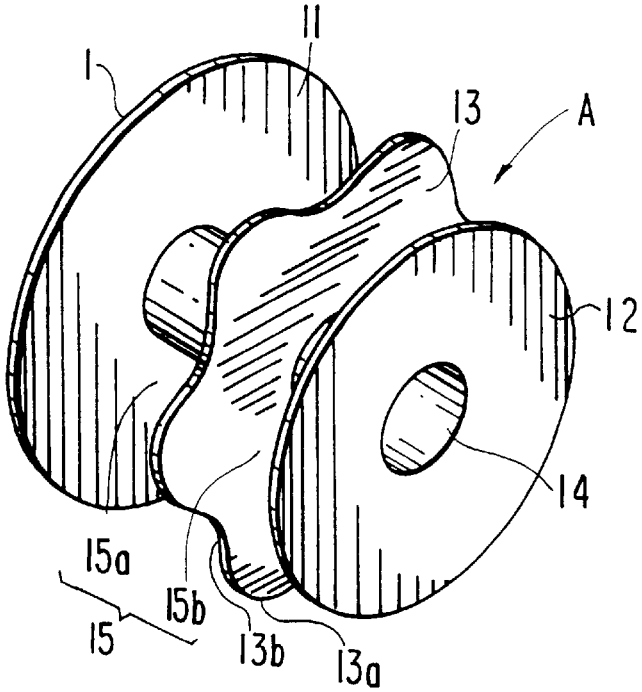
FIG. 4 is a perspective view of a shuttle bobbin for sewing machines in accordance with the second embodiment of the present invention.

FIG. 4 is a perspective view of a shuttle bobbin for sewing machines in accordance with the second embodiment of this invention. In the second embodiment, the general shape of the bobbin A remains the same as that described for the primary embodiment, but the toothed configuration of the partition wall 13 is altered. That is, the rounded roots 13*b* of the toothed partition wall 13 according to the second embodiment have the same configuration as those of the primary embodiment, but the rounded teeth 13*a* of the partition wall 13 are rounded at a slightly sharper degree in comparison with those of the primary embodiment. However, it should be understood that neither the number of teeth 13*a* and roots 13*b* of the toothed partition wall 13 nor the toothed configuration of the partition wall 13 is specifically limited.

As described above, the present invention provides a shuttle bobbin for sewing machines. In the shuttle bobbin of this invention, the thread winding hub is partitioned by a partition wall into first and second winding parts having different thread carrying capacities, with the second winding part being positioned just under the lowest position of a sewing needle when the bobbin is installed in a sewing machine. The thread carrying capacity of the shuttle bobbin according to this invention is thus enlarged by the capacity, offered by the second winding part, in comparison with a typical shuttle bobbin. Due to the enlarged thread carrying capacity of this shuttle bobbin, it is possible to lengthen the interval of changing an empty bobbin with a new, full bobbin of thread, thus improving work efficiency while performing a sewing operation. This effectively reduces the sewing cost while manufacturing sewn products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shuttle bobbin for sewing machines, comprising:

a hub having an axial pin hole, thus being rotatably and removably fitted over a pin of an openable bobbin case;

first and second disc-shaped end walls concentrically and integrally formed at both ends of said hub, respectively, said first end wall having an outer diameter larger than that of the second end wall; and a partition wall concentrically and integrally formed at an intermediate portion of said hub, thus partitioning the hub into first and second winding parts, said partition wall being smoothly toothed at its outside edge, thus having rounded teeth and rounded roots all around the outside edge.

2. The shuttle bobbin according to claim 1, wherein said rounded teeth of the partition wall form an addendum circle having a diameter equal to the outer diameter of the first end wall.

3. The shuttle bobbin according to claim 1, wherein said rounded roots of the partition wall form a deddendum circle having a diameter equal to the outer diameter of the second end wall.

4. The shuttle bobbin according to claim 1, wherein said second winding part is defined by both the second end wall and the partition wall and is positioned just under a lowest position of a sewing needle when the bobbin is installed in a sewing machine.

* * * * *